US007179057B2

(12) United States Patent
Walker et al.

(10) Patent No.: US 7,179,057 B2
(45) Date of Patent: Feb. 20, 2007

(54) VELOCITY PROFILE IMPELLER VANE

(75) Inventors: Craig I. Walker, Frenchs Forest (AU); Aleksander S. Roudnev, De Forest, WI (US)

(73) Assignee: Weir Slurry Group, Inc., Madison, WI (US)

( * ) Notice: Subject to any disclaimer, the term of this patent is extended or adjusted under 35 U.S.C. 154(b) by 46 days.

(21) Appl. No.: 10/814,427

(22) Filed: Mar. 31, 2004

(65) Prior Publication Data

US 2005/0220620 A1 Oct. 6, 2005

(51) Int. Cl.
*F04D 29/24* (2006.01)

(52) U.S. Cl. ..... 416/186 R; 416/228; 416/223 B

(58) Field of Classification Search ..... 416/185, 416/186 R, 223 B, 228
See application file for complete search history.

(56) References Cited

U.S. PATENT DOCUMENTS 2,471,174 A * 5/1949 Trumpler ..... 415/58.6
3,221,398 A * 12/1965 Mayne ..... 29/889.4
3,904,306 A * 9/1975 Navelsaker ..... 415/52.1
4,761,115 A * 8/1988 Hopfensperger ..... 415/119
4,781,531 A * 11/1988 James ..... 415/199.1
5,628,616 A * 5/1997 Lee ..... 415/58.2
6,877,955 B2 * 4/2005 Higashimori et al. ..... 416/185

* cited by examiner

*Primary Examiner*—Ninh H. Nguyen
(74) *Attorney, Agent, or Firm*—Morriss O'Bryant Compagni

(57) ABSTRACT

In accordance with the present invention, an impeller for use in a centrifugal pump has at least one vane the radially outer terminal end of which is configured to produce a flow velocity profile that controls and reduces the wear caused by slurry fluid being expelled from the impeller on the inner surface of the pump casing. The impeller vanes of the present invention are generally configured with a radially outwardly extending portion, as compared with the conventional straight or concave edge of an impeller vane. The outwardly extending portion may vary in shape, but is selected to produce a flow velocity profile that reduces wear in the pump casing.

21 Claims, 6 Drawing Sheets

VELOCITY PROFILE IMPELLER VANE

BACKGROUND OF THE INVENTION

1. Field of the Invention

This invention relates to pump impellers and specifically relates to an impeller having vanes particularly configured to selectively determine the velocity profile of the impeller to thereby selectively modify the wear of the pump casing when processing slurries.

2. Description of Related Art

Rotodynamic pumps are used in a variety of industries to process liquids and slurries. The type of fluid being processed dictates the type and configuration of the pump that is used in the particular application. That is, pumping clear liquid places less demand on pumps than does the processing of slurries, which contain an amount of solids or particulate matter that is abrasive and degrading to the internal structures of the pump.

Therefore, pump designers and engineers must consider the type of fluid or slurry that is going to be processed and select or design an impeller and pump casing that is most suitable to the application. For example, in the processing of clear liquids (e.g., water), it is typical that the pump casing is a volute, the shape of which changes in cross sectional area from the cutwater of the pump to near the outlet of the pump, and comparatively little wear is observed in the pump casing.

In the processing of slurries however, pump designers must consider the effect of hydraulic surface geometry not only from the point of optimizing pump efficiency, but also from the standpoint of minimizing wear in the pump casing. Thus, it has been typical in slurry pump design to modify the general volute shape of clear liquid-processing pumps to provide, for example, wider impeller outlets and casings with parallel sides.

Another factor that determines wear on the pump casing is the shape of the impeller vanes. Specifically, the outer edge of the vanes of the impeller have been demonstrated to significantly effect the flow velocity of fluid moving through the pump. It has been observed that the typical vane configuration having a straight outer edge, at or near the periphery of the shroud, produces a certain fluid velocity that leads to wear on the pump casing along the sides of the volute.

Thus, it would be advantageous in the art to provide an impeller having vanes that are specifically designed or configured to produce a more even wear pattern thus extending the overall wear life of the pump casing when processing slurries, particularly those with high solids content and/or particularly abrasive solids content.

BRIEF SUMMARY OF THE INVENTION

In accordance with the present invention, an impeller is provided having at least one vane that is particularly shaped at the outer terminal end thereof to produce flow velocities that are less deleterious to wear on the pump casing when processing slurries. The vane configurations of the present invention are adaptable for use in any rotodynamic pump which employs an impeller, but is described and illustrated herein in connection with use in a centrifugal slurry pump.

The impeller of the present invention comprises at least one vane which extends from at or near a center point of the impeller, corresponding to the central axis of the pump, and extends radially outwardly toward the peripheral edge of the impeller where the vane has a defined outer terminal end.

The impeller of the present invention may have a single shroud (generally known as a semi-open impeller), two shrouds (generally known as a closed impeller) or may have no shroud (generally known as an open impeller). The invention is described herein, however, as having at least one shroud, which is positioned for orientation toward the drive side of the pump casing (i.e., opposite the inlet of the pump).

The outer terminal end of the vanes of the present invention are configured with a radially outwardly extending portion that generally defines a convex-like edge of the vane. As used herein, the term "convex" is not meant to be limited to the conventional definition of a curved surface, but is meant only to convey that the outer terminal edge of the vane extends radially outwardly relative to the center axis of the impeller, rather than being straight or curved radially inwardly toward the center axis of the impeller; however, the outer terminal edge may be any shape, including but not limited to hemispherical, curvilinear, or comprised of two or more intersecting lines.

The convex-like outer terminal end of the vanes of the present invention generally produces a fluid velocity profile that reduces wear on the inside surface of the pump casing. The shape of the convex-like outer terminal end of the vanes may be particularly selected to specifically modify or determine the fluid velocity profile so that, given a particular type of slurry being processed, the wear on the pump casing can be controlled and reduced.

BRIEF DESCRIPTION OF THE SEVERAL VIEWS OF THE DRAWINGS

In the drawings, which illustrate what is currently believed to be the best mode for carrying out the invention.

DETAILED DESCRIPTION OF THE INVENTION

Figure 1:
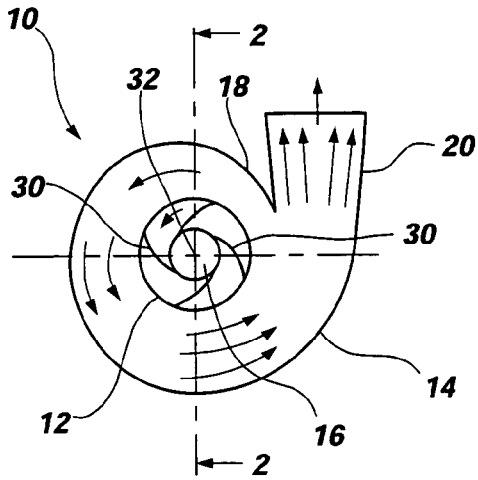
FIG. 1 is a representational view in elevation of a centrifugal pump illustrating a typical volute pump casing.

FIG. 1 illustrates representationally a conventional centrifugal pump 10 comprising an impeller 12 and a pump casing 14. An inlet 16 is provided through the pump casing 14, which delivers incoming fluid to the impeller 12. The pump casing 14 that is depicted in FIG. 1 is a volute-type casing which extends from a cutwater 18 to a discharge 20. As indicated by the arrows positioned within the pump casing 14 in FIG. 1, and as further illustrated in the cross section view of FIG. 2, it can be seen that the cross section area of the pump volute typically increases from the cutwater 18 of the pump 10 toward the discharge 20 of the pump 10.

Figure 2:
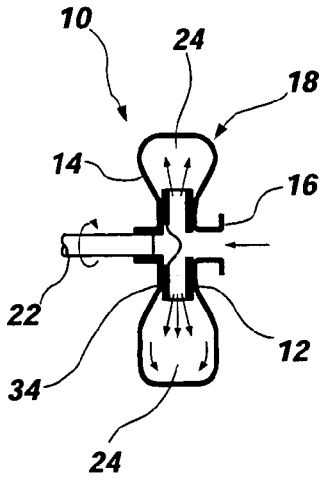
FIG. 2 is a representational view in cross section of the pump illustrated in FIG. 1, taken at line 2—2.

As depicted in FIG. 2, as the impeller 12 is rotated by the drive shaft 22, fluid entering the inlet 16 moves into the impeller 12 and is expelled outwardly into the volute 24 of the pump casing 14. The expelled fluid is further moved along the volute 24 of the pump casing 14 from the cutwater 18 to the discharge 20 and encounters a progressively larger cross sectional area of the pump casing 14, as depicted in FIG. 2.

As further shown representationally in FIG. 1, the impeller 12 of a conventional pump has at least one vane 30, and usually a plurality of vanes 30, which radiates outwardly from a point at or near the center 32 of the impeller 12. As shown more clearly in FIG. 3, for example, the impeller 12 may have a shroud 34, which is generally formed as a flattened disk having a center point 32 corresponding to the center axis of the pump. The vanes 30 extend outwardly from at or near the center 32 of the shroud 34 toward the peripheral edge 36 of the shroud 34 where the vane 30 terminates. Each vane 30 has a leading face 38 against which the incoming fluid impacts as the fluid is expelled radially outwardly toward the volute 24 of the pump casing 14 (FIG. 2).

Figure 3:
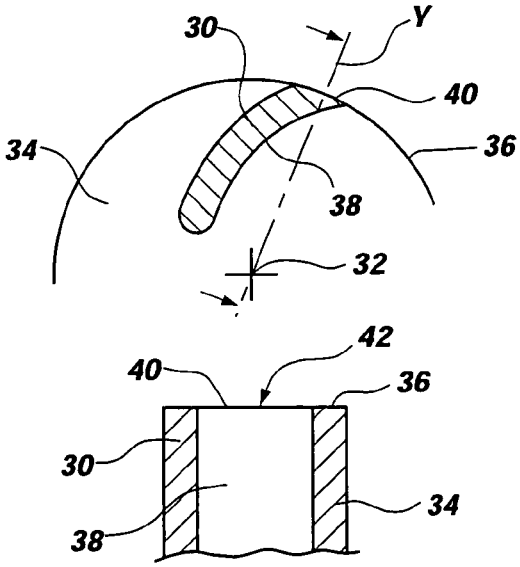
FIG. 3 (PRIOR ART)
FIG. 3 is a partial view in cross section of a conventional impeller vane illustrating the terminal end of the vane, which is a straight edge.

Again referring to FIG. 3, the outer terminal end 40 of each vane 30 defines an edge 42, as shown in cross sectional view taken at line Y through the vane 30. FIG. 3 depicts a first conventional configuration for a vane 30 which has a straight edge at the outer terminal end 40 of the vane 30. The straight outer edge 42 of this conventional type of vane 30 is generally co-terminus with the peripheral edge 36 of the shroud 34, as shown.

Figure 4:
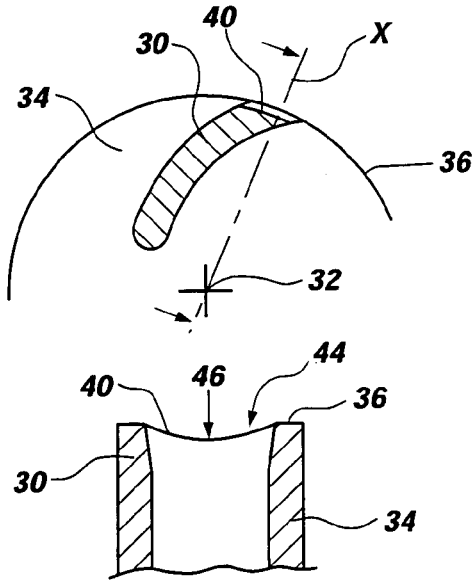
FIG. 4 (PRIOR ART)
FIG. 4 is a partial view in cross section of another conventional impeller vane illustrating the terminal end of the vane, which is concave.

FIG. 4 illustrates another conventional configuration of an impeller vane 30 where the outer edge 44 of the outer terminal end 40 of the vane 30 is concave, as illustrated in the cross section view taken at line X through the vane 30. That is, the outer edge 44 curves inwardly toward the center point 32 of the shroud 34 and the center 46 of the outer edge 44 is not co-terminus with the peripheral edge 36 of the shroud 34.

Figure 5:
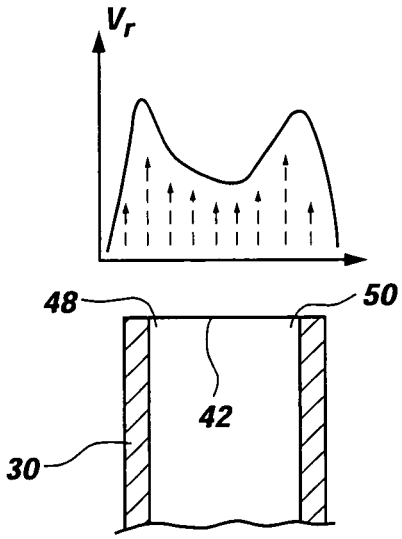
FIG. 5 (PRIOR ART)
FIG. 5 is a schematic representation of the fluid velocity profile of a vane having a terminal end as shown in FIG. 3.

It has been demonstrated that the shape of the terminal end of the vane effects the flow velocity of fluid exiting the impeller, and thereby effects the type or pattern of wear that may be experienced in the pump casing when processing slurries. As depicted in FIG. 5, for example, it has been shown that a conventional vane having a straight outer edge 42 produces a flow velocity profile where fluid is expelled at a higher velocity at or near the axial sides 48, 50 of the vane than from the center of the vane between the axial sides 48, 50. Consequently, a wear pattern in the pump casing occurs on either side of the volute in a spiral-type pattern.

Figure 6:
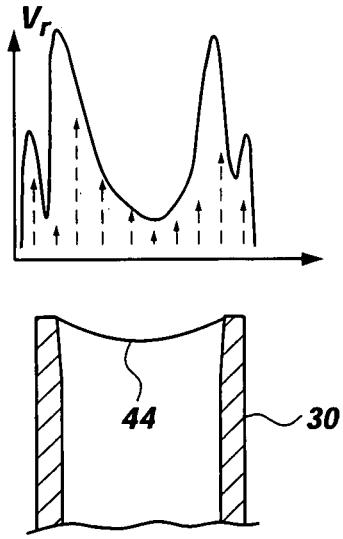
FIG. 6 (PRIOR ART)
FIG. 6 is a schematic representation of the fluid velocity profile of a vane having a terminal end as shown in FIG. 4.

As demonstrated in FIG. 6, the flow velocity profile produced by a conventional vane having a concave outer edge 44 is similar to the flow velocity profile produced by a vane having a straight outer edge 42, except that a double spike of flow velocity occurs, or is produced, at the axial ends of the vane. Consequently, a double spiral wear pattern is observed along the volute of the pump casing when processing slurries through the pump. In both conventional vane configurations shown in FIGS. 5 and 6, relatively less wear occurs at the center of the volute of the pump.

Figure 7:
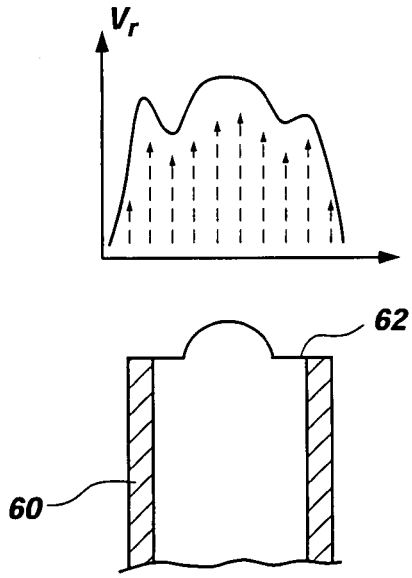
FIG. 7 is a schematic representation of the fluid velocity profile of a vane configuration of the present invention, the terminal end of which comprises an outwardly extending edge.

In view of the foregoing, it would be advantageous to provide a vane configuration having an outer terminal end that is suitably shaped to produce a flow velocity profile that results in more controlled and reduced wear in the volute of the pump casing compared to conventionally known impeller vanes. The inventors have discovered that a vane 60 having a generally convex-like outer edge 62, as illustrated, for example, in FIG. 7, produces a flow velocity profile where the velocities are more evenly distributed across the volute of the pump casing, thereby resulting in more even wear of the internal casing surface than what would normally occur with conventional vane configurations.

Figure 8:
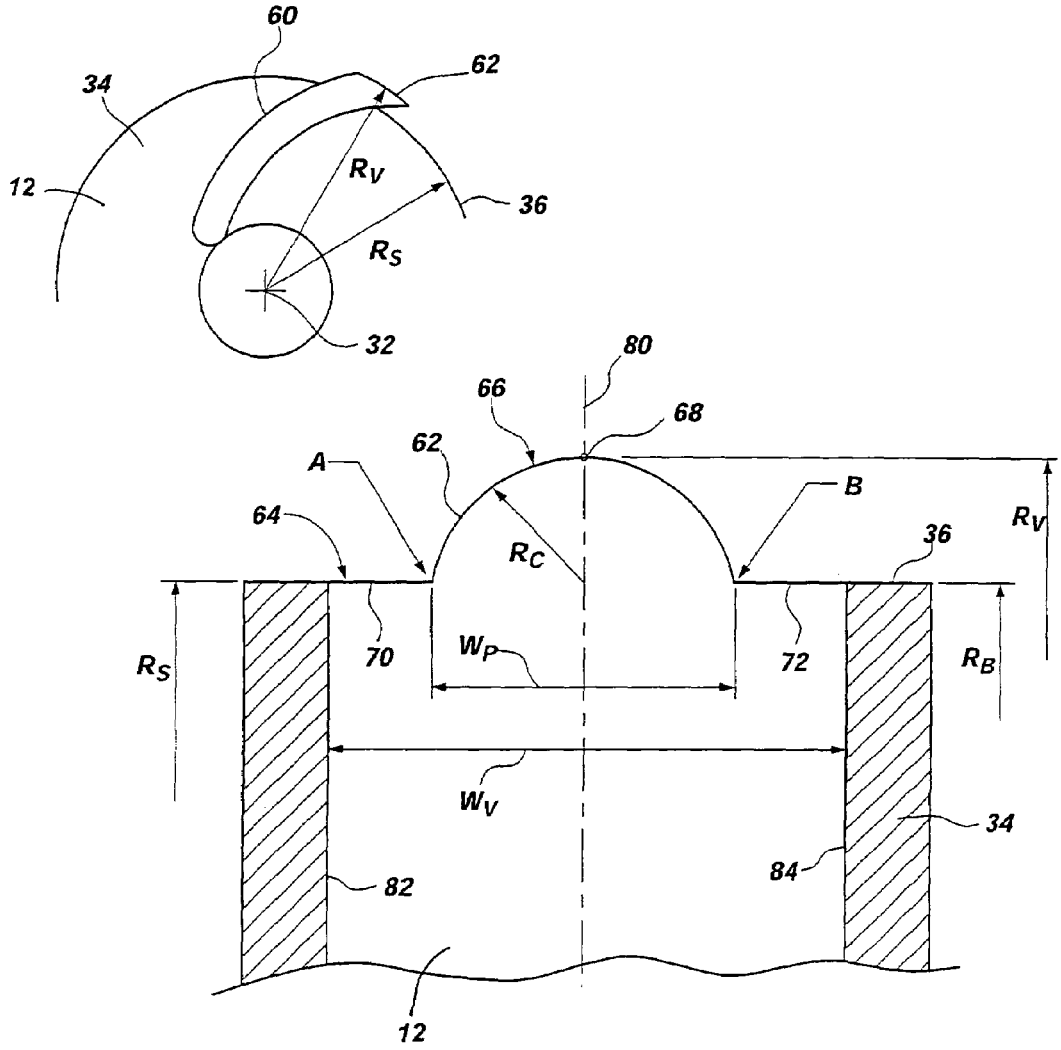
FIG. 8 is a representational view in cross section of a first embodiment of the present invention.

FIG. 8 more clearly illustrates that, in general, the impeller vane 60 of the present invention has an outer terminal end 64 defining an outer terminal edge 62 that is convex-like in shape in that the outer edge 62 includes a radially outwardly extending portion 66 that extends beyond the peripheral edge 36 of the shroud 34. Thus, the radius $R_V$ of the outwardly extending portion 66, as measured from the center 32 of the impeller 12 to the outermost terminus 68 of the vane 60, is greater than the radius $R_S$ of the shroud 34. As explained more fully below, the shape of the outwardly extending portion 66 of the terminal end 64 may vary, and may be specifically selected to produce the desired flow velocity profile consistent with the pumping requirements of a given application.

FIG. 8, however, illustrates a first embodiment of the invention where the outer terminal end 64 of the vane 60 has an outwardly extending portion 66 that has a radius $R_V$ which is greater than the radius $R_S$ of the shroud 34. The outer edge 62 of the vane 60 is also configured with a portion 70, 72 on either side of the outwardly extending portion 66 that has a radius $R_B$, which, in this embodiment, is equal to the radius $R_S$ of the shroud 34. Thus, the vane 60 has a width $W_V$ and the outwardly extending portion 66 has a width $W_P$ that is less than the width $W_V$ of the vane 60. It should be noted that in equally suitable alternative embodiments described more fully below, the width $W_P$ of the outwardly extending portion 66 may be equal to the width $W_V$ of the vane 60.

In the first embodiment of the present invention shown in FIG. 8, the outwardly extending portion 66 is generally arcuate in shape as measured from Point A to the terminus 68 of the outwardly extending portion 66 thence to Point B. Thus, by way of example only, the outwardly extending portion 66 may have a radius $R_C$. However, the arcuate line between Point A, the terminus 68, and Point B need not have a consistent radius (i.e., an arc). Those of skill in the art, consistent with the disclosure hereof, will understand that the dimensions of the arcuate or curvilinear line forming the outwardly extending portion 66 may be suitably varied to produce a desired flow velocity profile as described.

Figure 9:
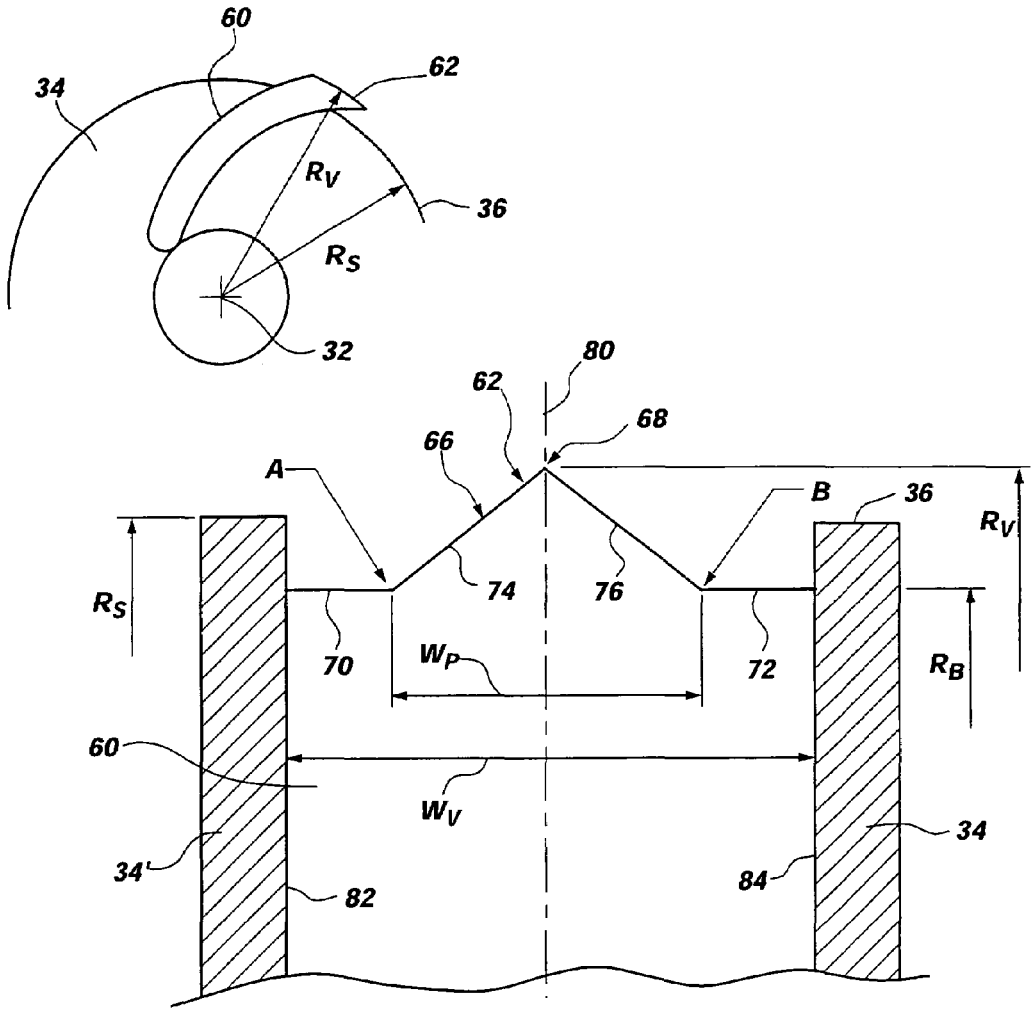
FIG. 9 is a representational view in cross section of a second embodiment of the present invention.

In an alternative embodiment of the invention shown in FIG. 9, the outer edge 62 of the vane 60 includes an outwardly extending portion 66 having a terminus 68 that defines a radius $R_V$ of the vane 60. The outer edge 62 further has a portion 70, 72 on either side of the outwardly extending portion 66 the radius $R_B$ of which is less than the radius $R_S$ of the shroud 34. Further, the radius $R_S$ of the shroud 34 is less than the radius $R_V$ of the outwardly extending portion 66. The outwardly extending portion 66 is defined between Point A, the terminus 68 of the vane 60, and Point B, and has a width $W_P$. The width $W_P$ of the outwardly extending portion 66 is less than the width $W_V$ of the vane 60.

In the alternative embodiment of FIG. 9, the outwardly extending portion 66 is illustrated, by way of example only, as being formed of two intersecting lines the first line 74 being defined between Point A and the terminus 68 of the vane 60, and the second line 76 being defined between the terminus 68 and Point B. This embodiment further serves to illustrate that the shape of the outwardly extending portion 66 can be other than an arcuate or curved line, as shown in FIG. 8, and can be comprised of a plurality of intersecting lines. Again, those of skill in the art will understand from the disclosure herein that the shape of the outer edge 62 of the vane 60 may be suitably modified in any variety of ways to provide a desired flow velocity profile.

The illustrated embodiments of the impeller vane of the present invention depict a terminus 68 of the vane 60 which is centered relative to the width $W_V$ of the vane 60. However, it should be noted that the terminus 68 may be located other than at the centerline 80 of the vane 60 and of the width $W_V$ as may be dictated by or required to achieve the desired flow velocity profile.

Figure 10:
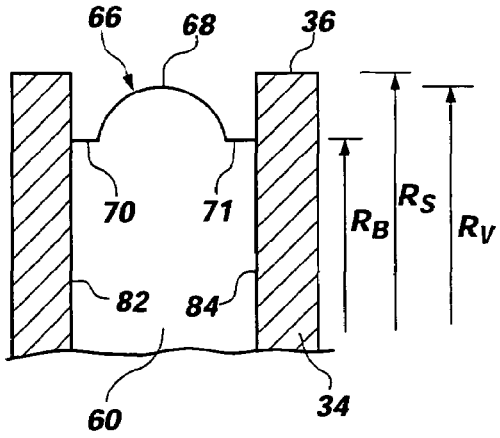
FIG. 10 is a representational view in cross section of a third embodiment of the present invention.
Figure 11:
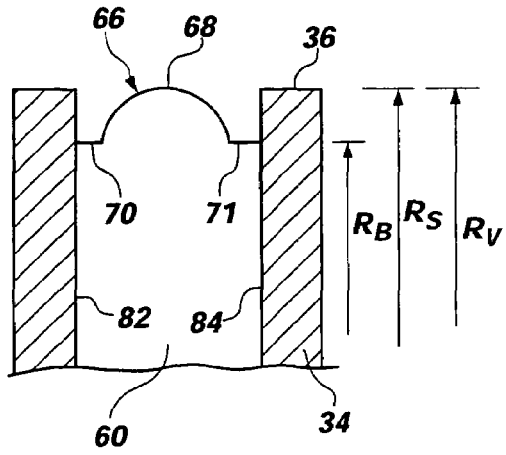
FIG. 11 is a representational view in cross section of a fourth embodiment of the present invention.

FIGS. 8 and 9 depict alternative embodiments of the invention where the vane radius $R_V$ is a representational view in cross section of a fifth embodiment of the present invention is greater than either the shroud radius $R_S$ and/or the base radius $R_B$. FIGS. 10 and 11 illustrate other alternative embodiment of the invention. FIG. 10, for example, illustrates an alternative embodiment where the vane radius $R_V$ is slightly less than the shroud radius $R_S$, and both the vane radius $R_V$ and shroud radius $R_S$ are greater than the base radius $R_B$.

Yet another alternative is illustrated in FIG. 11 where the radius RV of the vane 60 and the radius $R_S$ of the shroud 34 are substantially equal, and both are greater than the base radius $R_B$ of the vane 60. Both of the embodiments illustrated in FIGS. 10 and 11 achieve a desired flow velocity that produces less wear on the volute of the pump casing. It should be noted that the convex-like outwardly extending portion 66 shown in FIGS. 10 and 11 is depicted as a hemispherical shape by way of example only, and other suitable convex-like shapes or dimensions are appropriate and/or useful.

Figure 12:
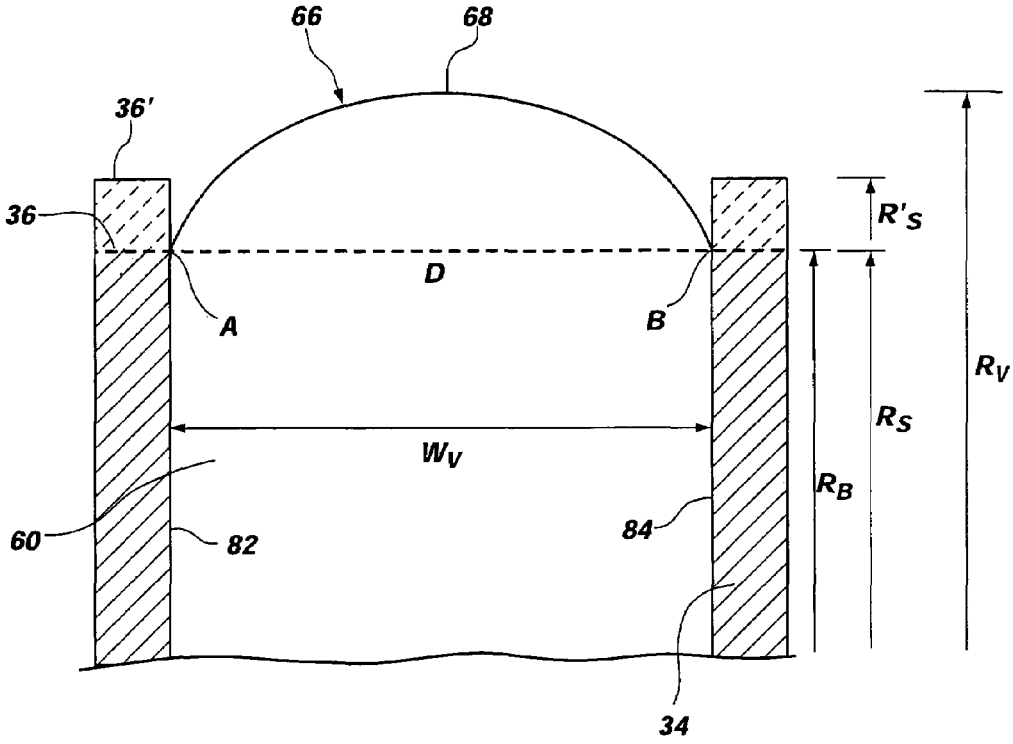
FIG. 12 is a representational view in cross section of a fifth and sixth embodiment of the present invention.

Further, as noted previously, the position of Point A and Point B, which define the opposing axial ends of the outwardly extending portion 66, may be located anywhere from nearer the center line 80 (FIGS. 8 and 9 ) of the vane 60 to the axial ends 82, 84 of the vane 60 as depicted in FIG. 12. Hence, the distance D between Point A and Point B may be from $D=W_V$ to about $D=W_V/3$, and Point A and Point B may be equally or unequally distanced from the centerline 80 of the vane 60.

Referring again to the embodiment of the invention shown in FIG. 12, the axial ends of the outwardly extending portion 66, defined as Point A and Point B, extend to the axial ends 82, 84 of the vane 60. As such, the illustrated embodiment of FIG. 12 does not have side portions (70, 71 ) as in the embodiments of FIGS. 8–11, but the axial ends (Point A, Point B) of the outwardly extending portion 66 may be viewed as defining the base radius $R_B$ of the vane 60. Thus, in a fifth embodiment of the invention shown in FIG. 12, the radius $R_V$ of the vane 60, defined from the center axis 32 of the impeller to the terminus 68 of the vane 60, is greater than the radius $R_S$ of the shroud 34, and the base radius $R_B$ is equal to the shroud radius $R_S$.

In a sixth alternative embodiment also shown in FIG. 12 in phantom line, the shroud 34 may extend beyond the base radius $R_B$ of the vane 60 a selected distance so that the peripheral edge 36' of the impeller extends to a radius $R_S'$. The radius $R_V$ of the vane 60 is, therefore, greater than $R_B$ and $R_S'$.

Figure 13:
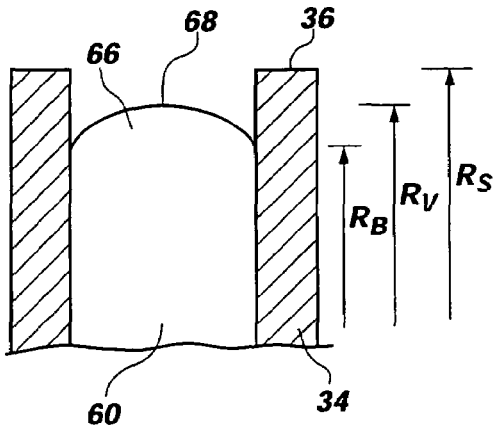
FIG. 13 is a representational view in cross section of a sixth embodiment of the present invention.

In a seventh alternative embodiment shown in FIG. 13, the terminus 68 of the vane 60 may not extend to the peripheral edge 36 of the shroud 34. Therefore, in this embodiment, the outwardly extending portion 66 of the vane 60 does not extend beyond the shroud 34, but still advantageously effects the flow velocity profile of the impeller. In the embodiment of FIG. 13, the radius $R_V$ of the vane 60 is greater than the base radius $R_B$, but less than the radius $R_S$ of the shroud 34.

Figure 14:
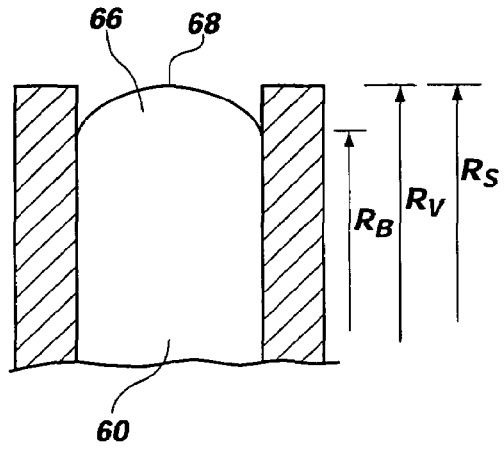
FIG. 14 is a representational view in cross section of a seventh embodiment of the present invention.

In still another alternative embodiment of the invention shown in FIG. 14, the terminus 68 of the vane 60 extends to a point substantially equal to the peripheral edge 36 of the shroud 34 such that the radius $R_V$ of the vane 60 and radius $R_S$ of the shroud 34 are equal, or substantially so, and the base radius $R_B$ is less than either the radius $R_V$ of the vane or the radius $R_S$ of the shroud. Again, although the convex-like edge of the embodiments illustrated in FIGS. 12–14 is arcuate, the outwardly extending portion 66 may be any suitable shape as previously described.

Regardless of the shape of the outwardly extending portion 66 of the vane 60 as illustrated and described previously, the area of the shape may preferably be between about 30% to about 85% of the area defined by $W_V(R_V-R_B)$. The following table illustrates by way of example only, some of the possible dimension ranges of the variables described herein, but is not meant to be an exhaustive definition of the ranges.

| | Minimum | Maximum | Preferable |
|---|---|---|---|
| $R_V$ | $1.02R_B$ | $1.15R_B$ | $1.06R_B$ |
| $W_P/W_V$ | 0.2 | 1 | 0.65 |
| $R_S$ | $R_B$ | $1.15R_B$ | $1.05R_B$ |

The impeller vanes of the present invention are configured to provide a selected flow velocity profile which controls and/or reduces wear on the pump casing caused by fluid slurry being expelled from the impeller toward the casing. The impeller vanes may be adapted for use in virtually any type, size or variety of rotodynamic pump. Those of skill in the art, conferring with the disclosure herein, will understand the changes and adaptations that may be made to employ the impeller vanes in various pumps to produce the desired flow velocity profile. Hence, reference herein to specific details or embodiments of the invention are by way of illustration only and not by way of limitation.

What is claimed is:

1. An impeller for a centrifugal pump comprising, at least one vane structured for use in a centrifugal pump to direct flow radially in a direction away from the central axis of the impeller, said at least one vane extending radially in length in a direction away from the central axis of the impeller to an outer peripheral edge of said impeller and having a centerline extending along said radial length which is perpendicular to said central axis of said impeller, said at least one vane having an outer terminal end at or near said peripheral edge of said impeller which is radially symmetrical about said centerline of said vane, said outer terminal end having an outwardly extending portion being convex-like in shape.

2. The impeller of claim 1 further comprising at least one shroud having a peripheral edge defining said peripheral edge of said impeller, said at least one vane extending outwardly from said shroud.

3. The impeller of claim 2 wherein said outwardly extending portion has a terminus and a radius $R_V$ measured from said central axis of said impeller to said terminus, and wherein said shroud has a radius $R_S$, measured from said central axis to said peripheral edge, wherein $R_V$ is equal to or greater than $R_S$.

4. The impeller of claim 3 wherein said outer terminal end of said at least one vane further comprises a portion having a radius $R_B$, where $R_B$ is less than or equal to $R_S$.

5. The impeller of claim 4 wherein said outwardly extending portion is arcuate in shape.

6. The impeller of claim 4 wherein said outwardly extending portion has an outer edge which is formed by the intersection of at least two lines.

7. The impeller of claim 4 wherein said at least one vane has a width $W_V$ and wherein said outwardly extending portion has a width $W_P$, where $W_P$, is less than or equal to $W_V$.

8. The impeller of claim 7 wherein the area of said outwardly extending portion is from about 30% to about 85% the area defined by $W_V(R_v-R_B)$.

9. The impeller of claim 2 wherein said at least one shroud has a radius $R_S$ measured from said central axis to said peripheral edge, and wherein said outwardly extending portion has a terminus and a radius $R_V$ measured from said central axis of said impeller to said terminus and said outwardly extending portion has axial ends defining a radius $R_B$ measured from said at least one axial end to said central axis, wherein $R_B$ is less than $R_V$ and $R_S$, and $R_V$ is less than $R_S$.

10. The impeller of claim 1 wherein said outwardly extending portion has an outer edge that is curved or arcuate.

11. The impeller of claim 1 wherein said outwardly extending portion has an outer edge formed by the intersection of at least two lines.

12. An impeller for a rotodynamic pump, comprising:

a shroud having a central axis and a peripheral edge radially spaced from said central axis, said shroud having a radius $R_S$;

at least one vane extending axially outwardly from said shroud and extending a length radially from at or near said central axis to said peripheral edge, thereby defining a centerline of said at least one vane which is perpendicular to said central axis of said shroud, said vane being secured to said shroud along the radial extension of said vane and having an outer terminal end positioned at or near said peripheral edge, wherein said outer terminal end comprises an outwardly extending portion that is radially symmetrical about said centerline of said vane and has a radius $R_V$ measured from said central axis to a terminus of said outwardly extending portion; and wherein $R_V$ is equal to or greater than $R_S$.

13. The impeller of claim 12 further comprising a second shroud positioned parallel to and spaced from said shroud and wherein said at least one vane extends between said spaced apart shrouds.

14. The impeller of claim 12 wherein said outer terminal end of said at least one vane further comprises a portion having a radius $R_B$, wherein $R_B$ is equal to $R_S$.

15. The impeller of claim 14 wherein said at least one vane has a width $W_V$, and wherein the shape of said outwardly extending portion is from about 30% to about 85% the area defined by $W_V(R_V-R_B)$.

16. The impeller of claim 15 wherein said outwardly extending portion has an outer edge which is shaped to produce a flow velocity profile selected to reduce wear in a pump casing.

17. The impeller of claim 12 wherein said outer terminal end of said at least one vane further comprises a portion having a radius $R_B$, wherein $R_B$ is less than $R_S$.

18. The impeller of claim 12 wherein said outwardly extending portion is convex-like in shape.

19. The impeller of claim 12 wherein said outwardly extending portion has an outer edge which is curved.

20. The impeller of claim 12 wherein said outwardly extending portion has an outer edge comprised of at least two intersecting lines.

21. The impeller of claim 12 wherein said at least one vane has a width $W_V$, and wherein the shape of said outwardly extending portion is from about 30% to about 85% of the area defined by $W_V(R_V-R_S)$.

* * * * *